US012768234B2

(12) United States Patent
Bilwal et al.

(10) Patent No.: US 12,768,234 B2
(45) Date of Patent: Oct. 20, 2026

(54) LINER HANGER FOR DEBRIS-LADEN ENVIRONMENT

(71) Applicant: Weatherford Technology Holdings, LLC, Houston, TX (US)

(72) Inventors: Kapil Bilwal, Navi Mumbai (IN); Frank D. Kalb, Cypress, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 0 days.

(21) Appl. No.: 18/901,127

(22) Filed: Sep. 30, 2024

(65) Prior Publication Data

US 2026/0085588 A1 Mar. 26, 2026

Related U.S. Application Data

(60) Provisional application No. 63/699,722, filed on Sep. 26, 2024.

(51) Int. Cl.
*E21B 23/06* (2006.01)
*E21B 43/08* (2006.01)

(52) U.S. Cl.
CPC ..... *E21B 23/06* (2013.01); *E21B 43/08* (2013.01)

(58) Field of Classification Search
CPC ..... E21B 23/06; E21B 43/08
See application file for complete search history.

(56) References Cited

U.S. PATENT DOCUMENTS 2,621,024 A * 12/1952 Koppl ..... E21B 31/1135 188/289
3,669,190 A * 6/1972 Sizer ..... E21B 43/105 166/207
3,763,932 A 10/1973 Dinning
3,804,164 A * 4/1974 Ellis ..... E21B 33/1291 166/134
4,049,055 A 9/1977 Brown
4,081,043 A * 3/1978 Juergens ..... E21B 31/113 175/301

(Continued)

FOREIGN PATENT DOCUMENTS

GB 2567838 A 5/2019
WO 2007131134 A2 11/2007

OTHER PUBLICATIONS

Int'l Search Report and Written Opinion in counterpart PCT Appl. No. PCT/US2025/041290, dated Dec. 12, 2025, 9 pgs.

*Primary Examiner* — Steven A Macdonald
(74) *Attorney, Agent, or Firm* — Cabello Hall Zinda, PLLC

(57) ABSTRACT

A liner hanger includes a housing, a packer, and an outer sleeve. The packer on the housing is actuated to seal in a wellbore. The outer sleeve can move on the housing to push a slip toward the packer. A fluid port defined in the outer sleeve communicates with an internal volume. A valve at the fluid port is configured to change from a closed state to an opened state. The valve in the closed state restricts fluid communication, while the valve in the opened state permits fluid communication from the wellbore annulus to the internal volume. The valve can include a plate and a cover affixed to the outer sleeve. The plate prevents debris from collecting and can bend open to permit fluid intake into the internal volume. The valve can alternatively include a breachable barrier or a dissolvable barrier.

26 Claims, 9 Drawing Sheets

(56) References Cited

U.S. PATENT DOCUMENTS 4,253,521 A * 3/1981 Savage ..... E21B 23/06 166/123
4,436,149 A * 3/1984 Edwards ..... E21B 34/14 166/120
4,441,552 A * 4/1984 Hamman ..... E21B 33/1294 166/120
4,457,369 A * 7/1984 Henderson ..... E21B 33/1293 166/134
4,669,538 A * 6/1987 Szarka ..... E21B 23/06 166/134
5,577,560 A * 11/1996 Coronado ..... E21B 23/06 166/66.4
8,453,724 B2 6/2013 Zhou
9,057,240 B2 6/2015 Smith et al.
9,518,452 B2 12/2016 Turley et al.
9,624,733 B2 4/2017 Fleetwood et al.
9,683,434 B2 6/2017 Machocki
10,329,868 B2 6/2019 Limb et al.
10,907,428 B2 2/2021 Luke et al.
11,377,930 B2 7/2022 Steele
11,773,672 B2 10/2023 Kalb et al.
12,371,961 B1 * 7/2025 Gorhum ..... E21B 23/06
2004/0140131 A1 * 7/2004 Susman ..... E21B 31/113 175/321
2010/0252252 A1 * 10/2010 Harris ..... E21B 23/06 166/120
2011/0108266 A1 5/2011 Smith et al.
2014/0083708 A1 * 3/2014 Beck ..... E21B 43/26 166/308.1
2015/0159469 A1 * 6/2015 Purkis ..... E21B 23/0413 166/185
2017/0058644 A1 * 3/2017 Andreychuk ..... E21B 34/14
2022/0364438 A1 * 11/2022 Mackay ..... E21B 34/14
2023/0033711 A1 * 2/2023 Kalb ..... E21B 23/0411
2023/0407720 A1 * 12/2023 Moyes ..... E21B 23/0413

* cited by examiner

LINER HANGER FOR DEBRIS-LADEN ENVIRONMENT

CROSS-REFERENCE TO RELATED APPLICATIONS

This application claims the benefit of U.S. Provisional Appl. No. 63/699,722 filed Sep. 26, 2024, which is incorporated herein by reference in its entirety.

BACKGROUND OF THE DISCLOSURE

As shown in FIG. 1, a liner assembly 20 includes a liner hanger 30 from which a liner 22 extends downhole. Although many configurations are possible, the distal end of the liner 22 may have a shoe track 24, which can include a float shoe 26, a float collar 27, and a landing collar 28. The float shoe 26 and collar 27 can have valves to allow fluid flow out a toe port 25 of the shoe track 24 and prevent reverse flow into the shoe track 24. Other configurations are possible.

In general, the liner hanger 30 has a housing 31, liner slips 35, and a hydraulic actuator 34. The hydraulic actuator 34 has an actuator port 33 in a bore 32 of the housing 31, and the hydraulic actuator 34 is configured to set the liner slips 35 in the borehole. The hydraulic actuator 34 communicates through the actuator port 33 with the bore 32 of the liner hanger's housing 31. Moved by hydraulic pressure, the hydraulic actuator 34 pushes the liner slips 35 against setting cones on the liner hanger 30 to engage the liner slips 35 inside the cased section 10 of the borehole when setting downhole.

As further shown, the liner assembly 20 includes a liner top packer 36 connected uphole of the liner slips 35 on the liner hanger 30. The liner top packer 36 is configured to set by compression in the cased section 10 of the borehole. Packer slips 37 uphole of the packer 36 can engage the cased section 10 to hold the packer 36 in a compressed state. Finally, a polished bore receptacle 38 is connected to a sleeve 39 having the packer slips 37.

The liner assembly 20 may be used in a downhole environment having heavy laden drilling fluid (e.g., 20 lbf/gal (ppg)). The major weighting component for the fluid may be barite. The barite in this fluid has the tendency to sag, deposit, or bridge in low flow velocity and low-pressure gradient areas within the fluid column.

Once the liner slips 35 are set, for example, a packer actuator (not shown) of the setting tool rests on top of the polished bore receptacle 38, and force is applied to push the polished bore receptacle 38 downhole while the housing 31 remains set in the cased section 10. The polished bore receptacle 38 pushes the sleeve 39 with its packer slips 37 downhole, and the sleeve 39 slides over the housing 31 to set the packer slips 37 and packer 36. In these setting operations, any deposited barite tends to accumulate in areas around the sleeve 39, the packer slips 37, and the like. This accumulation of barite tends to create hydraulic lock and increase the required actuation force to move the polished bore receptacle 38 and the sleeve 39 to set the packer slips 37 and the packer 36.

To deal with the issues noted above, a solution known in the prior art is shown in the example of FIGS. 2A-2C. Once the liner slips (35) are set, the packer actuator (not shown) of the setting tool rests on top of polished bore receptacle 38, and force is applied to push the polished bore receptacle 38 downhole. The polished bore receptacle 38 pushes the connected sleeve 39 having the packer slips (37), and the sleeve 39 slides over the housing 31 to set the packer slips (37) and the packer (36). This movement increases an empty volume 40 between the hanger's housing 31 and the sleeve 39 as shown in FIG. 2C. If there is no place for fluid intake, the fluid can create a hydraulic lock between the hanger's housing 31 and the sleeve 39 and can restrict the sleeve 39 from sliding over the hanger's housing 31 to set the packer (36).

To prevent above hydraulic lock, breathing slots 48 as shown in FIG. 2A are defined in the sleeve 39. These breathing slots 48 can be defined where the shear screws 44*a* are located. These breathing slots 48 let fluid intake into the empty volume 40 and can help to avoid hydraulic lock between the hanger's housing 31 and the sleeve 39.

Because these breathing slots 48 are open, there is a high possibility of debris depositing in the breathing slots 48. Accumulation of debris in the breathing slots 48 can resist fluid intake during packer set-in and can cause hydraulic lock between the hanger's housing 31 and the sleeve 39.

The subject matter of the present disclosure is directed to overcoming, or at least reducing the effects of, one or more of the problems set forth above.

SUMMARY OF THE DISCLOSURE

The subject matter of the present disclosure relates to a downhole tool for use in a wellbore. The downhole tool comprises a housing, an outer sleeve, an actuator, and a valve. The housing defines a bore therethrough, and the outer sleeve is movable relative to the housing at least from a first position to a second position relative to the housing. The outer sleeve defines an internal volume with the housing and defines a fluid port, which communicates the internal volume with a wellbore annulus. The actuator is disposed on the housing and is actuated in response to the movement of the outer sleeve toward the second position. The valve is disposed at the fluid port on the outer sleeve and is configured to change from a closed state to an opened state. The valve in the closed state at least restricts fluid communication from the internal volume to the wellbore annulus, and the valve in the opened state permits fluid communication from the wellbore annulus to the internal volume.

In one configuration, the actuator comprises a packer that seals the wellbore annulus upon the movement of the outer sleeve. In another configuration, the actuator comprises a slip that engages the wellbore in response to the movement of the outer sleeve. The downhole tool may function as a liner hanger, with the slip positioned between the outer sleeve and the packer.

In yet another configuration, the housing can further define a side port communicating with the bore. The actuator can comprise a flow sleeve disposed on the housing. The flow sleeve, which can define a side opening, can be moveable from a closed condition to an opened condition in response to the movement of the outer sleeve toward the second position. The side opening of the flow sleeve in the closed condition can be sealed from fluid communication with the side port, while the side opening of the flow sleeve in the opened condition can be sealed in fluid communication with the side port.

The subject matter of the present disclosure also encompasses a downhole tool, such as a liner hanger, comprising a packer and a slip, actuatable by an outer sleeve movable relative to a housing. A valve at a fluid port controls fluid flow between the internal volume and the wellbore annulus, transitioning from a closed state to an opened state in response to a pressure differential or exposure to a downhole environmental factor.

In one arrangement of the valve, the valve may comprise a plate that moves in response to pressure differential changes. The plate can be disposed at the fluid port in the outer sleeve. At least a portion of the plate can move from the closed state to the opened state in response to the pressure differential between the wellbore annulus and the internal volume. For example, the plate can define a proximal end and a distal end. The proximal end can be disposed adjacent to the fluid port and can be disposed against an external surface of the outer sleeve. For its part, the distal end can extend over the fluid port, and the distal end can be movable relative to the proximal end. A groove defined in the plate can divide the proximal end from the distal end, and the groove can be tuned to a threshold of the pressure differential. Accordingly, the distal end can be configured to bend, flex, detach, or snap at the groove.

Further to this arrangement, the valve can comprise a cover being affixed to the outer sleeve against the plate. The cover can define an aperture therein, and the plate can be movable relative to the aperture. The plate can define a lip extending beyond the aperture of the cover, and the lip on the plate in the closed state can engage against the cover. Additionally, the plate can have a central portion raised above a surface of the plate. This central portion can fit into the aperture of the cover when the plate is in the closed state. Moreover, the cover can define a rim disposed about a perimeter of the cover, and the rim can surround an edge of the plate in the closed state. Finally, the valve can comprise a fixture attaching the plate and the cover to the outer sleeve.

In another arrangement of the valve, the valve can comprise a breachable barrier disposed across the fluid port. The breachable barrier can be configured to change from the closed state to the opened state in response to a positive threshold of the pressure differential. The breachable barrier can be configured to resist the change from the closed state to the opened state in response to at least an equalized threshold of the pressure differential.

In yet another arrangement of the valve, the valve can comprise a dissolvable barrier disposed across the fluid port. The dissolvable barrier can be configured to change from the closed state to the opened state in response to exposure to a downhole environmental factor.

In configurations of the downhole tool, the outer sleeve can comprise a collar and a polished bore receptacle. The collar can be disposed on the housing and can have the slip. The polished bore receptacle can be connected to the collar and can extend partially beyond an uphole end of the housing. Additionally, the downhole tool can comprise a seal disposed between the housing and the outer sleeve, and the seal can seal the internal volume therebetween. Also, the outer sleeve can define a fill port adjacent to the fluid port. This fill port can communicate with the internal volume, and the fill port can be configured to receive grease into the internal volume and being closed by a plug.

The subject matter of the present disclosure further encompasses a liner system comprising a liner hanger and a liner extending from it. The liner hanger can have any of the configurations of the downhole tool discussed above.

Finally, the subject matter of the present disclosure includes methods for actuating a downhole tool or setting a liner hanger within a wellbore. These methods involve deploying the tool, actuating an actuator by moving the outer sleeve, restricting fluid flow through a valve in a closed state, and permitting fluid communication by changing the valve to an opened state in response to pressure differentials or environmental factors.

In particular, one method directed to actuating a downhole tool in a wellbore can comprise: deploying the downhole tool in the wellbore, the downhole tool having an outer sleeve disposed on a housing and defining an internal volume therebetween, the outer sleeve defining a fluid port communicating the internal volume with the wellbore, the fluid port having a valve, the valve being changeable from a closed state to an opened state; at least restricting, through the valve in the closed state, fluid communication through the fluid port from the wellbore to the internal volume; actuating an actuator on the housing by moving the outer sleeve relative to the housing; and permitting fluid communication from the wellbore to the internal volume by changing the valve from the closed state to the opened state.

Another method directed to setting a liner hanger in a wellbore can comprise: deploying the liner hanger in the wellbore, the liner hanger having an outer sleeve disposed on a housing and defining an internal volume therebetween, the outer sleeve defining a fluid port communicating the internal volume with the wellbore, the fluid port having a valve, the valve being changeable from a closed state to an opened state; at least restricting, through the valve in the closed state, fluid communication through the fluid port from the wellbore to the internal volume; setting a packer on the housing by moving the outer sleeve relative to the housing; and permitting fluid communication from the wellbore to the internal volume by changing the valve from the closed state to the opened state.

Any of the disclosed methods can further involve performing steps associated with the features of the downhole tool or liner hanger discussed above.

The foregoing summary is not intended to summarize each potential configuration or every aspect of the present disclosure.

DETAILED DESCRIPTION OF THE DISCLOSURE

Figure 1:
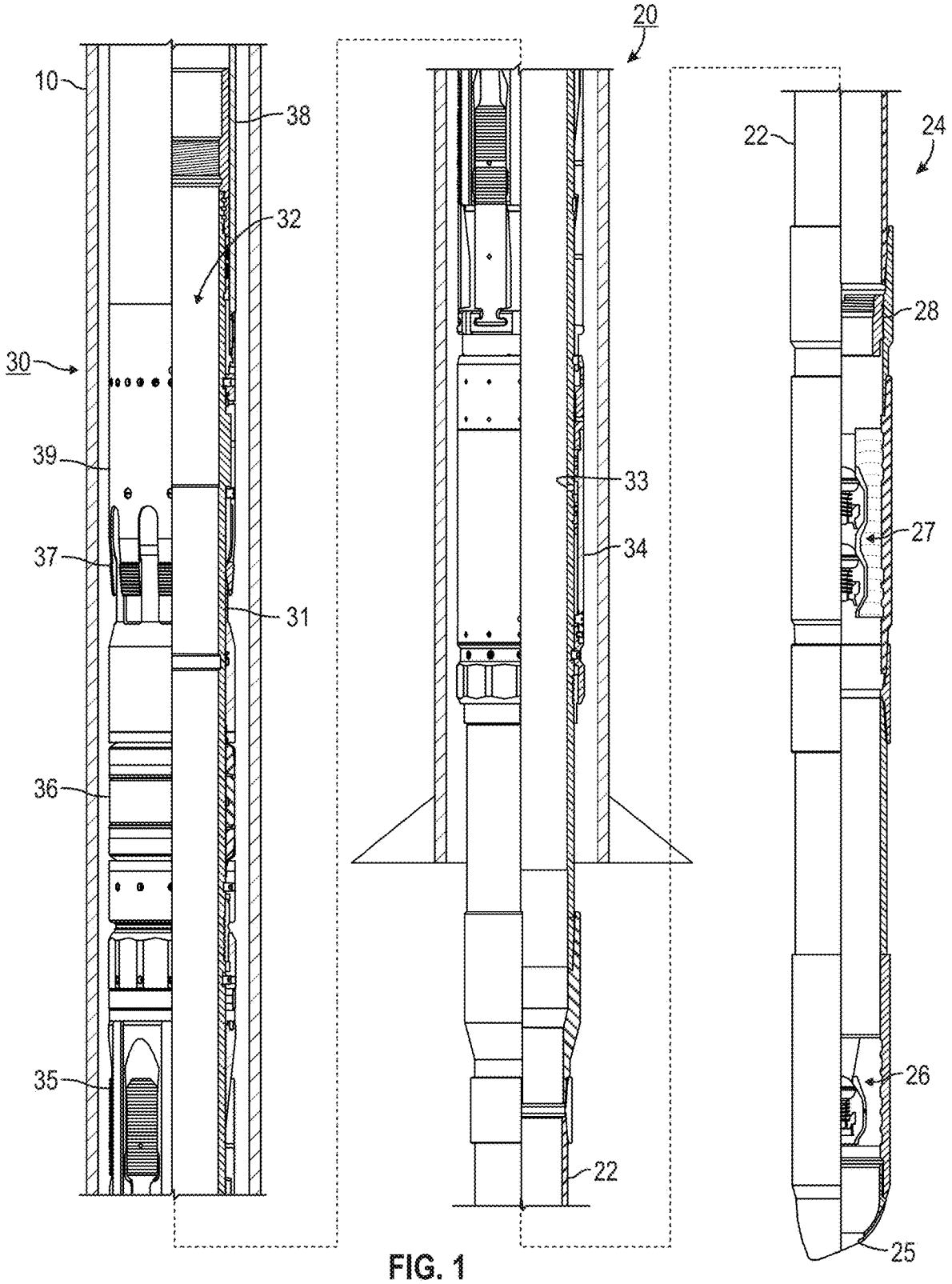
FIG. 1 (Background Art)
FIG. 1 illustrates a liner assembly according to background of the present disclosure.
Figure 2C:
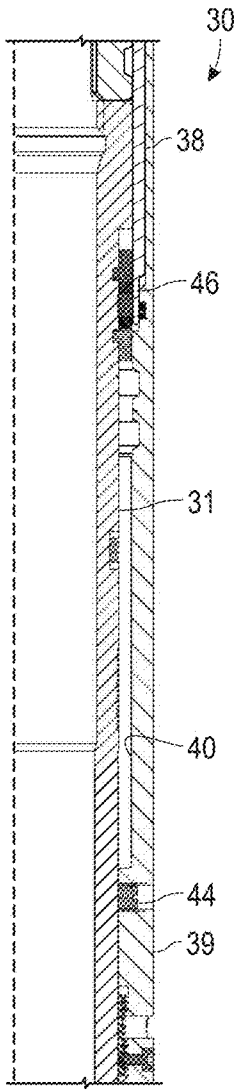
FIG. 2C (Prior Art)
FIGS. 2B-2C illustrate cross-sections of the liner hanger of the prior art during packer setting.
Figure 2B:
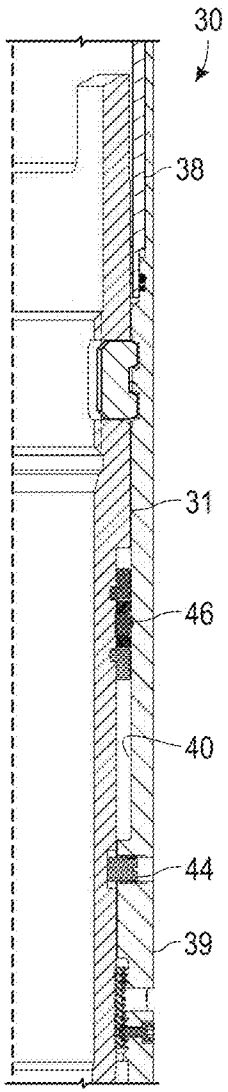
FIG. 2B (Prior Art)
Figure 2A:
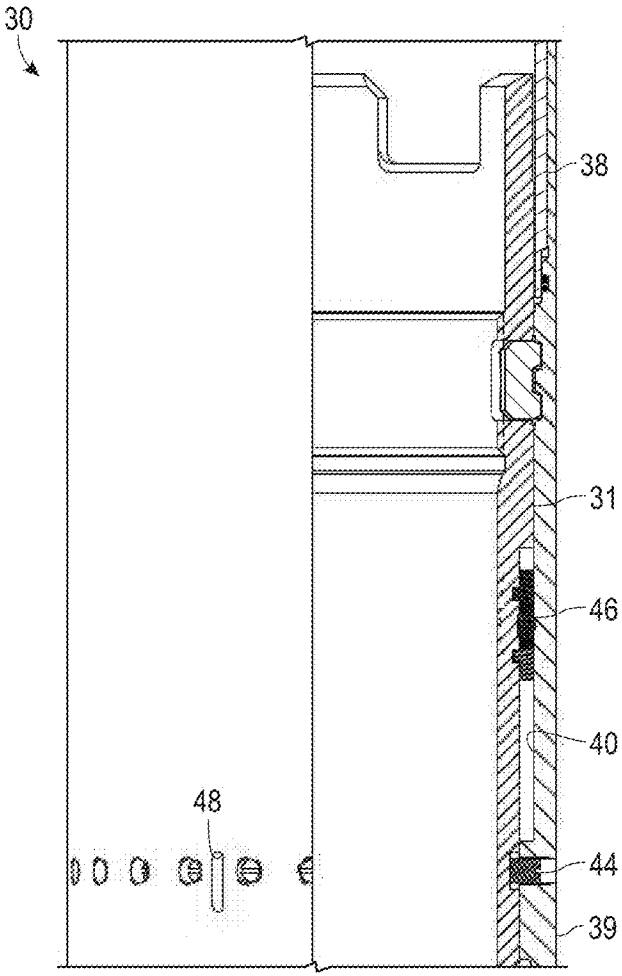
FIG. 2A (Prior Art)
FIG. 2A illustrates a portion of a liner hanger according to the prior art.
Figure 3:
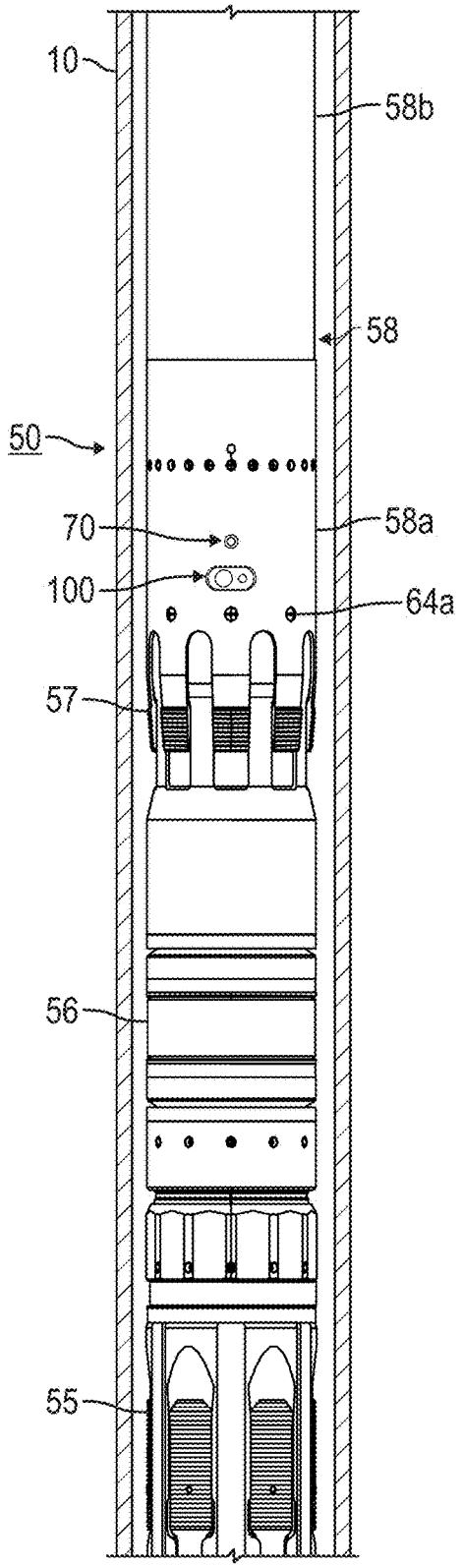
FIG. 3 illustrates a portion of a downhole tool (e.g., a liner hanger) according to the present disclosure.
Figure 4:
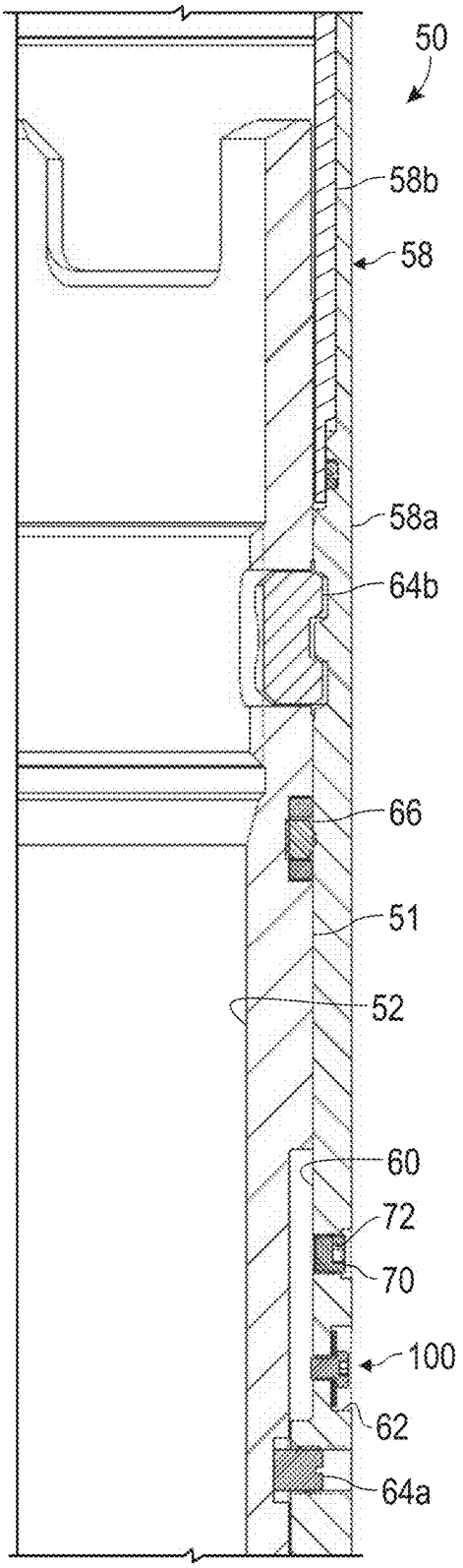
FIG. 4 illustrates a cross-section of a detailed portion of the disclosed liner hanger.

FIG. 3 illustrates a portion of a downhole tool 50 according to the present disclosure, and FIG. 4 illustrates a cross-section of a detailed portion of the disclosed downhole tool 50. The downhole tool 50 as shown here is a liner hanger, which can be used on a liner assembly in a wellbore. As will be appreciated with the benefit of the present disclosure, other downhole tools can benefit from the teachings disclosed herein.

Features of the liner hanger 50 can be similar to that discussed in the Background of the present disclosure. The liner hanger 50 includes a housing 51, liner slips 55, a packer 56, packer slips 57, and an outer sleeve 58. As shown, the outer sleeve 58 typically has a slip portion 58*a* coupled to a polished bore receptacle 58*b*. The slip portion 58*a* may include the packer slips 57 extending from the downhole edge.

The housing 51 defines a bore 52 threrethrough. The packer 56 is disposed on the housing 51 and has an end ring or cone adjacent to a packing element. During setting, the liner slips 55 are set in a wellbore (e.g., cased section) 10. The packer 56 is then actuated to seal a wellbore annulus in the cased section 10. The outer sleeve 58 (having the slip portion 58*a* and the polished bore receptacle 58*b*) disposed on the housing 31 are moved toward the packer 56 to compress the packer 56 and move the packer slips 57 against the end ring.

As conventionally used, shear pins 64*a* temporarily retain the outer sleeve 58 to the housing 51, and dogs 64*b* may engage in a profile of the outer sleeve 58. Moreover, a seal 66 can also seal the space between the housing 51 and the outer sleeve 58. The outer sleeve 58 defines an internal cavity, space, or volume 60 with the housing 51. This internal volume 60 is typically annular, as depicted here.

A valve 100 is disposed at a fluid port 62, which is defined in the outer sleeve 58 and communicates with the internal volume 60. As discussed in more detail below, the valve 100 acts as a debris-resistant assembly and can change from a closed state to an opened state. The valve 100 in the closed state at least restricts fluid communication through the fluid port 62 from the internal volume 60 to the wellbore annulus outside the liner hanger 50. Meanwhile, the valve 100 in the opened state permits fluid communication through the fluid port 62 from the wellbore annulus to the internal volume 60.

A threaded hole 72 in the outer sleeve 58 can be provided to add grease to the internal volume 60, and a plug 70 can close the hole 72. The hole 72 and the plug 70 can use tapered thread for sealing purposes. The grease can be added to the low-pressure gradient areas in the internal volume 60 between the housing 51 and outer sleeve 58.

Figure 5:
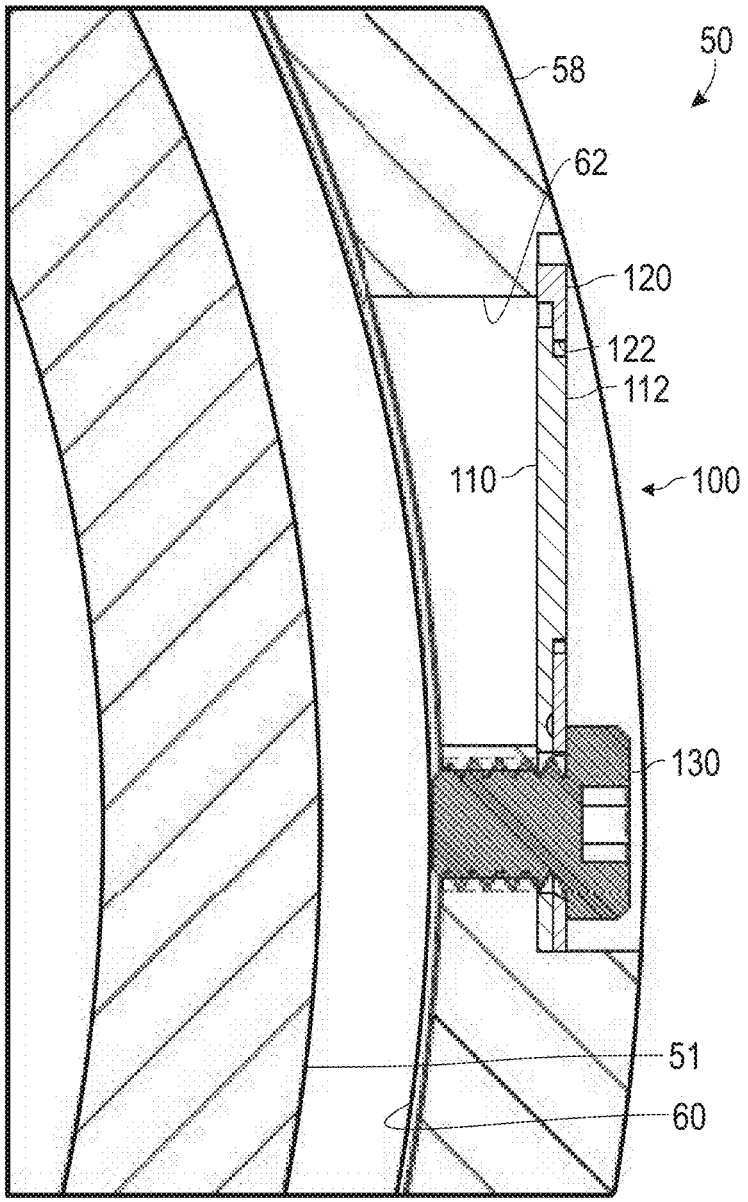
FIG. 5 illustrates an end-section of a portion of the disclosed liner hanger having a first configuration of a valve of the present disclosure.
Figure 6A:
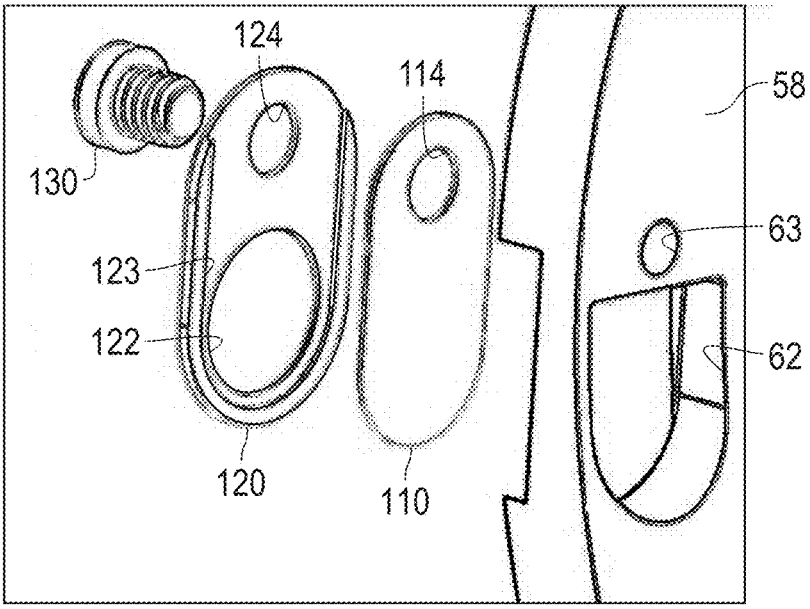
FIG. 6A illustrates an exploded view of the first configuration of the valve of the present disclosure relative to an outer sleeve of a slip assembly for the disclosed liner hanger.
Figure 6B:
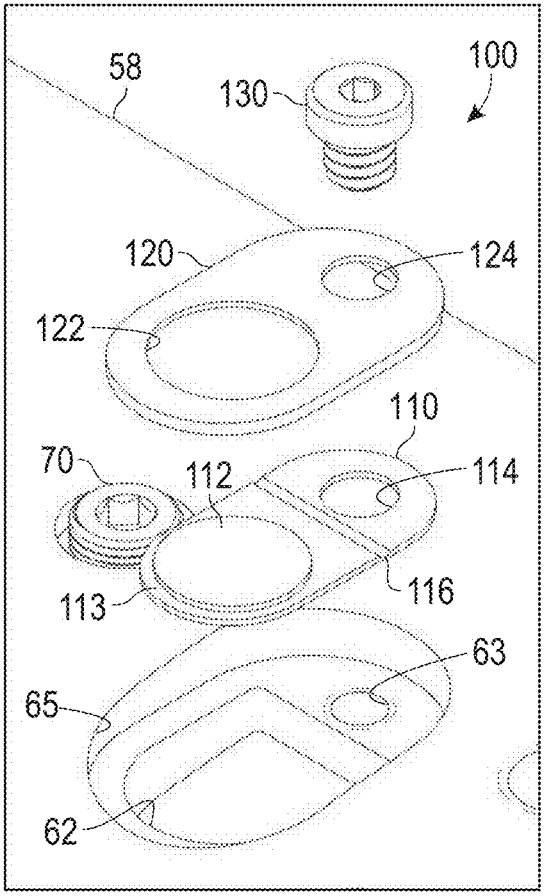
FIG. 6B illustrates another exploded view of the first configuration of the valve of the present disclosure relative to the outer sleeve.

In a first configuration, the valve 100 is configured to change from the closed state to the opened state in response to a pressure differential between the wellbore annulus and the internal volume 60. FIG. 5 illustrates an end-section of a portion of the disclosed liner hanger 50 having the first configuration of the valve 100 of the present disclosure. FIG. 6A illustrates an exploded view of the first configuration of the valve 100 of the present disclosure relative to the outer sleeve 58 for the disclosed liner hanger 50, and FIG. 6B illustrates another exploded view of the first configuration of the valve 100 of the present disclosure relative to the outer sleeve 58.

The valve 100 includes a plate 110 disposed at the fluid port 62 in the outer sleeve 58. At least a portion of the plate 110 moves from the closed state to the opened state in response to the pressure differential between the wellbore annulus and the internal volume 60. For example, the fluid port 62 is wider than the plate 110 so the fluid port 62 allows a portion of the plate 110 to open freely and lets fluid to enter the internal volume 60.

For example, the plate 110 can have a proximal end and a distal end. The proximal end is disposed against an external surface of the outer sleeve 58, and the distal end extends over the fluid port 62. The distal end of the plate 110 is movable relative to the proximal end, which is affixed to the outer sleeve 58. To facilitate movement of the distal end, the plate 110 can define a groove 116 that divides the ends of the plate 110. The groove 116 can be tuned to bend, flex detach, snap, or the like in response to a threshold of the pressure differential across the outward and inward facing surfaces of the plate 110.

As also shown, the valve 100 includes a cover 120 affixed to the outer sleeve 58 against the plate 110. The cover 120 is also a plate and defines an aperture 122, which can communicate with the fluid port 62. During operation, the plate 110 is movable relative to this aperture 122.

Overall, the cover 120 can be larger than the plate 110. As best shown in FIG. 6B, for example, the plate 110 can define a peripheral lip 113. The peripheral lip 113 on the plate 110 in the closed state extends beyond the aperture 122 of the cover 120 so the peripheral lip 113 engages against the underside of the cover 120. This engagement can prevent the distal end of the plate 110 from bending, flexing, or otherwise moving away from the fluid port 62. Yet, the distal end of the plate 110 can move away from the cover 120 and can move toward or into the fluid port 62. As best shown in FIG. 6A, the cover 120 can define a rim or inner profile 123 disposed about a perimeter on the underside of the cover 120. The rim 123 can surround an edge of the plate 110 in the closed position. The inner profile 123 is larger than the plate 110 so the plate 110 can rest in the rim 123 and can open easily without catching on the cover 120.

As further shown in FIG. 6B, the plate 110 can also have a central portion 112 that is raised above the outward facing surface of the plate 110. When the plate 110 is in the closed state, the plate's central portion 112 can fit into the aperture 122 of the cover 120. This can help to prevent debris from collecting and bridging at the aperture 122 of the cover 120.

Finally, a fixture 130 can attach the plate 110 and the cover 120 to the outer sleeve 58. For example, the fixture 130 can be a cap screw extending through holes 114, 124 in the plate 110 and the cover 120 to affix to a threaded hole 63 adjacent to the external fluid port 62. Although the plate 110 may be affixed at one location using the fixture 130 and the hole 114, the cover 120 can be larger and can be affixed in additional places. These and other configurations can be used to hold the components of the valve 100 adjacent to the fluid port 62 in the outer sleeve 58.

The valve 100, acting as a debris-resistant assembly, prevents debris from depositing at low pressure gradient areas, such as the internal volume 60 of the liner hanger 50. Then, during operation, the valve allows for fluid intake through the external fluid port 62, which acts as a breathing slot, to enter the internal volume 60 to prevent hydraulic lock. For example, the plate 110 moves inward toward the fluid port 62 when suction pressure is created by the internal volume 60.

As noted, the groove 116 defined in the plate 110 creates a weaker section on the plate 110 and can act as a hinge plane. Accordingly, the distal end of the plate 110 can bend, flex, pivot, or the like at this groove 116. The force required to move the distal end of the plate 110 can be varied by adjusting the depth and/or width of the groove 116.

As best shown in FIG. 6B, a profiled recess 65 can be machined in the outer sleeve 58. This profiled recess 65 has the fluid port 62 and has the threaded hole 63 for the cap screw 130. The valve 100 can position in this profiled recess 65 so the components do not extend outside the outer diameter of the outer sleeve 58.

The cover 120 is sized larger than the fluid port 62. The cover 120 rests on an outer face of the profiled recess 65 and can cover all the plate 110. This restricts any debris from entering inside the internal volume 60 and acts to cover for the plate 110. The size and number of the fluid ports 62 used on the liner hanger 50 can be determined by flow rate calculations, the amount of internal volume, and other factors. In one implementation, four fluid ports 62 can be defined about the circumference of the outer sleeve 58, and each of the fluid ports 62 can have a corresponding valve 100 to restrict debris and control fluid intake.

Figure 7A:
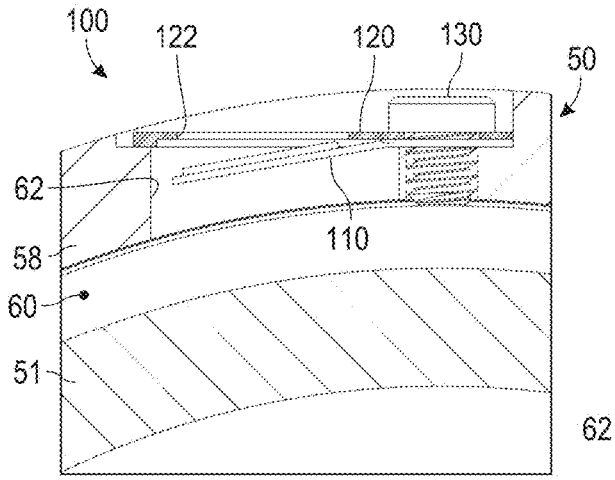
FIGS. 7A-7D illustrate end-sections of a portion of the disclosed liner hanger having the first configuration of the valve in various stages of operation.
Figure 7C:
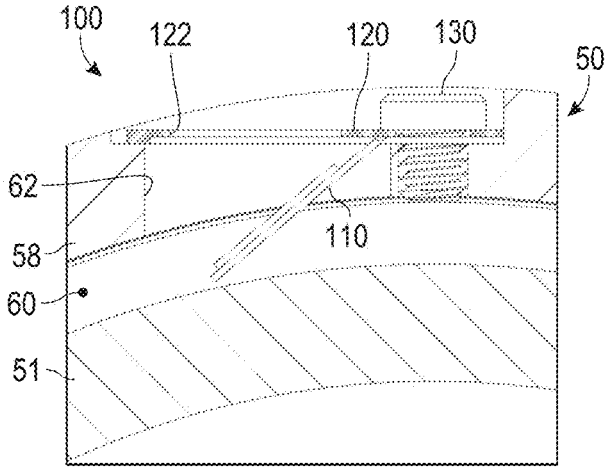
Figure 7B:
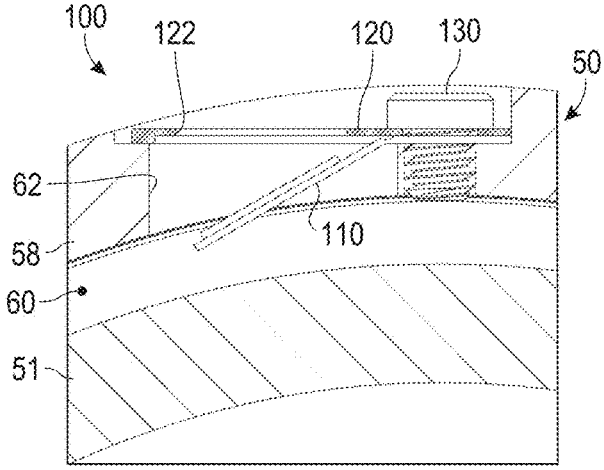
Figure 7D:
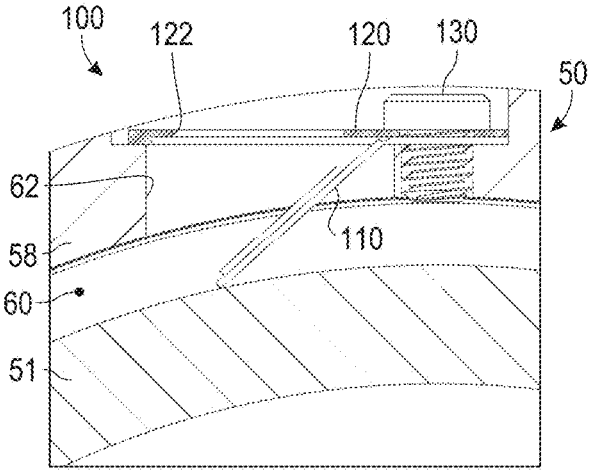

During run-in hole, the plate 110 is closed against the cover 120 of the valve 100 to prevent debris from entering inside packer slip's low pressure gradient areas, such as the internal volume 60. Once the liner hanger 50 is set, the packer actuator (not shown) of the setting tool pushes the outer sleeve 58 (having the polished bore receptacle (58*b*) and slip portion (58*a*)) to set the liner packer (56). The outer sleeve 58 pushes the outer sleeve 58 to slide over hanger's housing 51, and the internal volume 60 between the housing 51 and the outer sleeve 58 starts increasing. At this moment, the plate 110 bends, flexes, pivots, or the like inward and opens the aperture 122 in cover 120. FIGS. 7A-7D illustrate end-sections of a portion of the disclosed liner hanger 50 having the first configuration of the valve 100 in various stages during opening. FIG. 7D shows a fully open position for the distal end of the plate 110. In one configuration, the distal end of the plate 110 may be pivoted at about 40 degrees and may contact against the hanger's housing 51. This open passage for fluid intake into the increasing internal volume 60 between the housing 51 and the outer sleeve 58. Thus, hydraulic lock between housing 51 and the outer sleeve 58 can be prevented.

Figure 8:
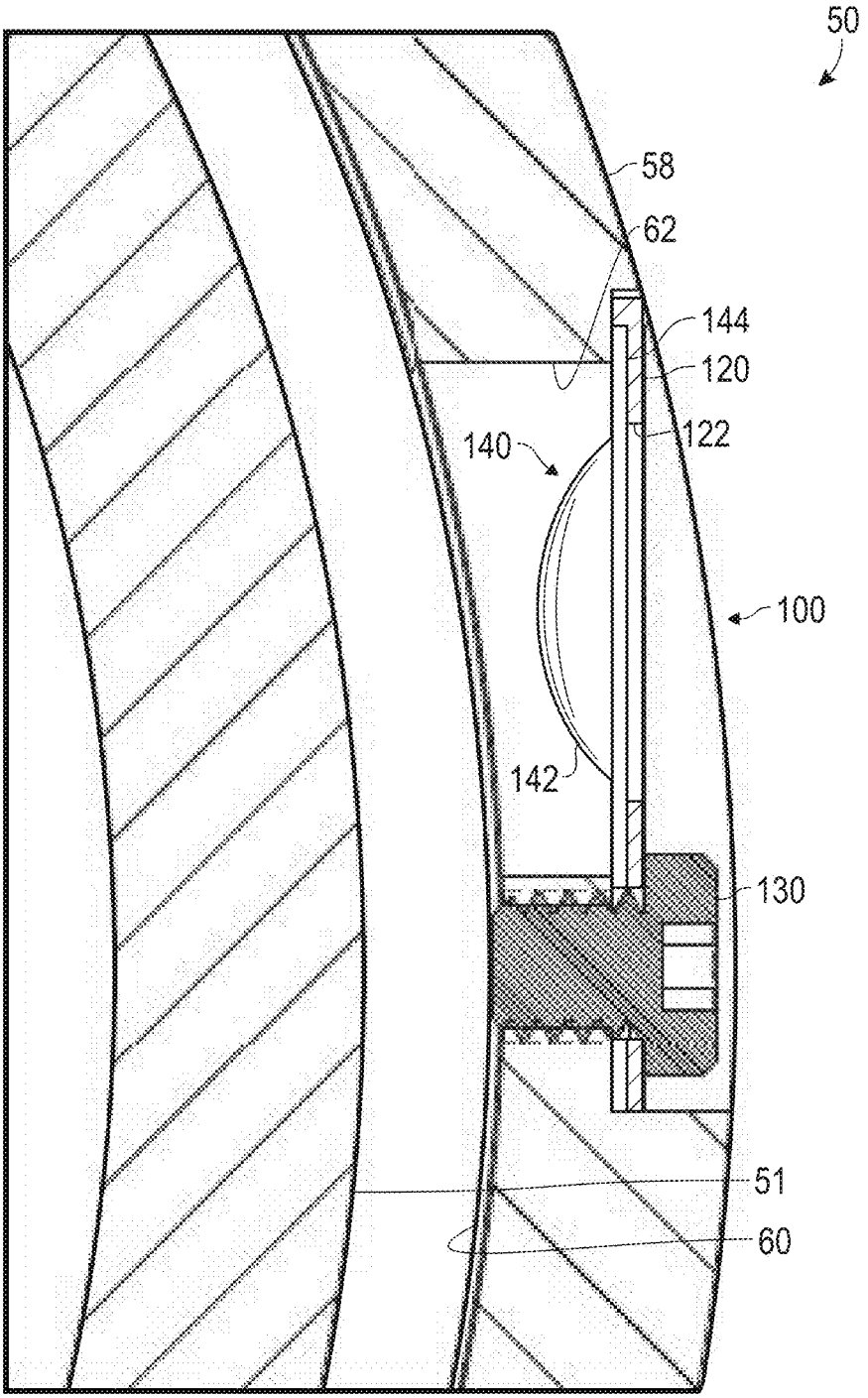
FIG. 8 illustrates an end-section of a portion of the disclosed liner hanger having a second configuration of a valve of the present disclosure.

FIG. 8 illustrates an end-section of a portion of the disclosed liner hanger 50 having a second configuration of a valve 100 of the present disclosure. This valve 100 is also configured to change from the closed state to the opened state in response to a pressure differential between the wellbore annulus and the internal volume 60.

The valve 100 includes a breachable barrier 140 disposed across the fluid port 62. The breachable barrier 140 is configured to change from the closed state to the opened state in response to a positive threshold of the pressure differential—i.e., the wellbore pressure outside the liner hanger 50 being greater than internal pressure of the internal volume 60 by a predefined limit. Meanwhile, the breachable barrier 140 is configured to resist the change from the closed state to the opened state in response to at least an equalized threshold of the pressure differential.

As shown, the breachable barrier 140 can be held against the surface of the outer sleeve 58 using a cover 120 and a cap screw 130, such as discussed previously. The cover 120 can include an aperture 122 that communicates with a central breachable portion 142 of the breachable barrier 140. Meanwhile, an outer perimeter 144 of the breachable barrier 140 surrounds the central breachable portion 142 and is shouldered against the outer sleeve's surface.

The breachable barrier 140 can at least hold a low-pressure differential of about 5 to 10 psi. In one example, the breachable barrier 140 can be a low-pressure rupture disc composed of a metal material and configured so the central breachable portion 142 is breached or ruptured by a predetermined pressure differential from the external facing side to the internal facing side. Alternatively, the breachable barrier 140 can be composed of a brittle metal material, a ceramic material, a frangible material, or the like. As shown, the central breachable portion 142 is typically concave on one side and convex on the other side. By design, the breachable barrier 140 is configured to "open" when the wellbore annulus pressure is greater within a predetermined limit relative to the pressure in the internal volume 60 of the liner hanger 50. However, the breachable barrier 140 is configured to resist being breached or ruptured when the pressures are at (or near) equalization and to resist breaching when any internal pressure in the internal volume 60 is greater than the wellbore annulus pressure at least within a negative limit.

Figure 9:
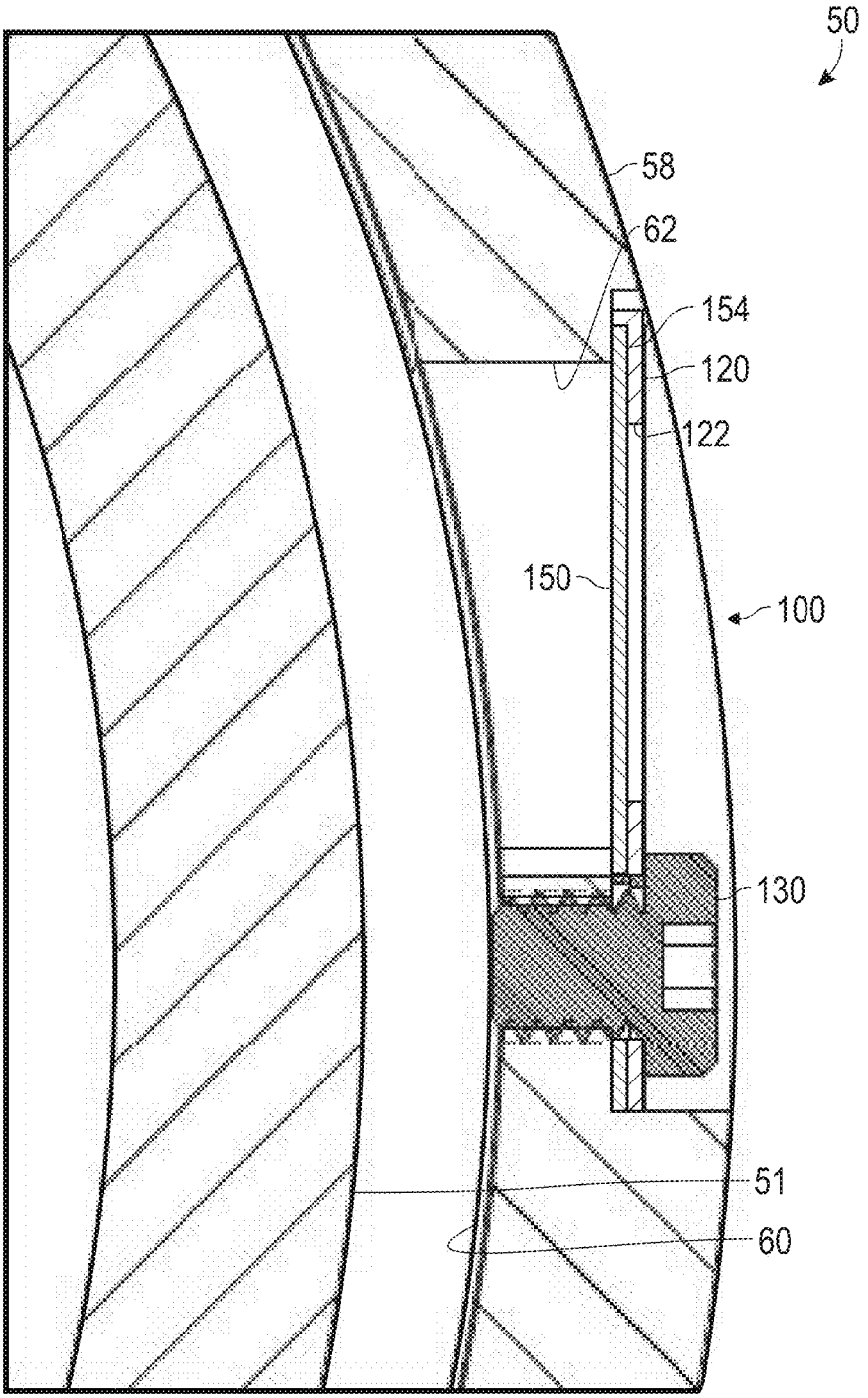
FIG. 9 illustrates an end-section of a portion of the disclosed liner hanger having a third configuration of a valve of the present disclosure.

FIG. 9 illustrates an end-section of a portion of the disclosed liner hanger 50 having a third configuration of a valve 100 of the present disclosure. The valve 100 includes a dissolvable barrier 150 disposed across the fluid port 62. As shown, the dissolvable barrier 150 can be held against the surface of the outer sleeve 58 using a cover 120 and a cap screw 130, such as discussed previously. The cover 120 can include an aperture 122 that communicates with a central portion of the dissolvable barrier 150. Meanwhile, an outer perimeter 154 of the dissolvable barrier 150 is shouldered against the outer sleeve's surface.

The dissolvable barrier 150 is configured to change from the closed state to the opened state in response to exposure to a downhole environmental factor. For example, the dissolvable barrier 150 can at least hold a low-pressure differential of about 5 to 10 psi. However, when exposed to the conditions in the wellbore during operation, the dissolvable barrier 150 can be self-removing, may dissolve away, or may be otherwise removed. To achieve this, the dissolvable barrier 150 can be composed a self-removable material selected from the group consisting of a dissolvable material, an erodible material, a disintegrable material, a degradable material, an aluminum, a reactive metal, a magnesium alloy, a degradable composite polymer, a polystyrene, an elastomer, a resin, an adhesive, a polyester, a polyamide, a thermoplastic polymer, a polyglycolide, a polyglycolic acid, and a thermosetting polymer. The self-removable material is meant to encompass any materials designed to dissolve, erode, disintegrate, or otherwise degrade over time and/or in certain wellbore conditions due to heat, temperature, fluid composition, or another factor.

The discussion presented above has described the inventive concepts with respect to a liner hanger. Other downhole tools can benefit from the teachings of the present disclosure—namely, a downhole tool having an internal volume that increases with actuation. For example, downhole tools including packers, anchors, sliding sleeves, and other completion tools can benefit from the teachings of the present disclosure.

Figure 10:
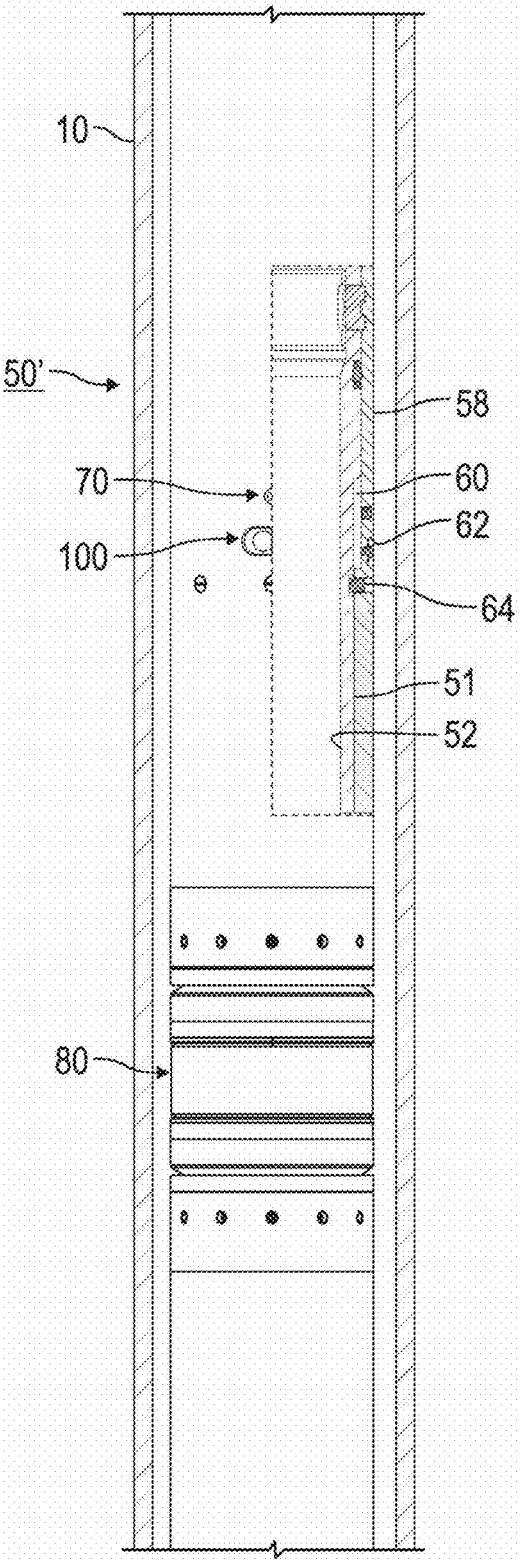
FIG. 10 illustrates a portion of another downhole tool according to the present disclosure.

As shown in FIG. 10, for example, a downhole tool 50' for use in a wellbore includes a housing 51, an outer sleeve 58, an actuator 80, and a valve 100 according to the present disclosure. The housing 51 defines a bore 52 therethrough, and the outer sleeve 58 is disposed on the housing 51. Temporary retainers 64, such as shear screws, can be used to retain the outer sleeve 58 to the housing 51. The outer sleeve 58 is movable at least from a first position to a second position relative to the housing 51.

The outer sleeve 58 defines an internal volume 60 with the housing 51 and defines a fluid port 62. The fluid port 62 communicates the internal volume 60 with the wellbore annulus. The valve 100 is disposed at the fluid port 62 on the outer sleeve 58 and is configured to change from a closed state to an opened state. The valve 100 in the closed state at least restricts fluid communication from the internal volume 60 to the wellbore annulus. The valve 100 in the opened state permits fluid communication from the wellbore annulus to the internal volume 60. In this way, the valve can compensate for the increase in the internal volume 60 during actuation of the downhole tool 50'.

The actuator 80 is disposed on the housing 51 and is actuated in response to the movement of the outer sleeve 58 toward the second position. As shown, the actuator 80 can include a packer disposed on the housing 51 and can be actuatable to seal a wellbore annulus in the wellbore in response to the movement of the outer sleeve 58 toward the second position. In another configuration, the actuator 80 can instead include a slip disposed on the housing 51 and can be actuatable to engage against the wellbore in response to the movement of the outer sleeve toward the second position. In yet another configuration, the actuator 80 can have both a slip and a packer with slip disposed between the outer sleeve 58 and the packer.

Figure 11:
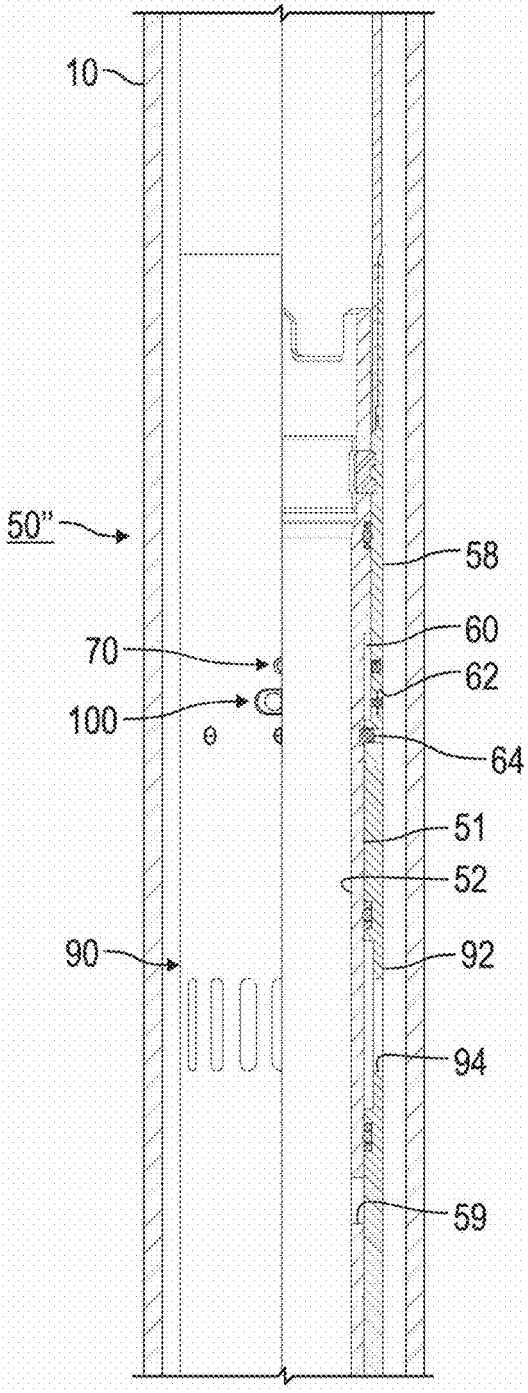
FIG. 11 illustrates a portion of yet another downhole tool according to the present disclosure.

As shown in FIG. 11, another downhole tool 50" for use in a wellbore includes a housing 51, an outer sleeve 58, an actuator 90, and a valve 100 according to the present disclosure. The housing 51 defines a bore 52 therethrough, and the outer sleeve 58 is disposed on the housing 51. Temporary retainers 64, such as shear screws, can be used to retain the outer sleeve 58 to the housing 51. The outer sleeve 58 is movable at least from a first position to a second position relative to the housing 51.

The outer sleeve 58 defines an internal volume 60 with the housing 51 and defines a fluid port 62. The fluid port 62 communicates the internal volume 60 with the wellbore annulus. The valve 100 is disposed at the fluid port 62 on the outer sleeve 58 and is configured to change from a closed state to an opened state. The valve 100 in the closed state at least restricts fluid communication from the internal volume 60 to the wellbore annulus. The valve 100 in the opened state permits fluid communication from the wellbore annulus to the internal volume 60. In this way, the valve can compensate for the increase in the internal volume 60 during actuation of the downhole tool 50".

The actuator 90 is disposed on the housing 51 and is actuated in response to the movement of the outer sleeve 58 toward the second position. As shown herein, the actuator 90 is a sliding sleeve arrangement. The housing 51 defines a side port 59 communicating with the bore 52. The actuator 90 comprises a flow sleeve 92 disposed on the housing 51 and defines a side opening 94. The flow sleeve 92 is moveable from a closed condition to an opened condition in response to the movement of the outer sleeve 58 toward the second position. The side opening 94 of the flow sleeve 92 in the closed condition is sealed from fluid communication with the side port 59, whereas the side opening 94 of the flow sleeve 92 in the opened condition is sealed in fluid communication with the side port 59.

Configurations of the present disclosure can be characterized by the following clauses:

1. a Downhole Tool (50) for Use in a Wellbore (10), the Downhole Tool (50) comprising:
   - a housing (51) defining a bore (52) therethrough;
   - an outer sleeve (58) disposed on the housing (51), the outer sleeve (58) being movable at least from a first position to a second position relative to the housing (51), the outer sleeve (58) defining an internal volume (60) with the housing (51) and defining a fluid port (62), the fluid port (62) communicating the internal volume (60) with a wellbore annulus;
   - an actuator (56, 57, 80, 90) disposed on the housing (51) and being actuated in response to the movement of the outer sleeve (58) toward the second position; and
   - a valve (100) disposed at the fluid port (62) on the outer sleeve (58) and being configured to change from a closed state to an opened state, the valve (100) in the closed state at least restricting fluid communication from the internal volume (60) to the wellbore annulus, the valve (100) in the opened state permitting fluid communication from the wellbore annulus to the internal volume (60).

2. The downhole tool of Clause 1, wherein the actuator comprises a packer disposed on the housing and being actuatable to seal the wellbore annulus in the wellbore in response to the movement of the outer sleeve toward the second position.

3. The downhole tool of Clause 1 or 2, wherein the actuator comprises a slip disposed on the housing, the slip being actuatable to engage against the wellbore in response to the movement of the outer sleeve toward the second position.

4. The downhole tool of Clause 3 when dependent upon Clause 2, wherein the downhole tool is a liner hanger, the slip disposed between the outer sleeve and the packer.

5. The downhole tool of Clause 1, wherein the housing defines a side port communicating with the bore; and wherein the actuator comprises a flow sleeve disposed on the housing and defining a side opening, the flow sleeve being moveable from a closed condition to an opened condition in response to the movement of the outer sleeve toward the second position, the side opening of the flow sleeve in the closed condition being sealed from fluid communication with the side port, the side opening of the flow sleeve in the opened condition being sealed in fluid communication with the side port.

6. The downhole tool of any one of Clauses 1 to 5, wherein the valve (100) is configured to change from the closed state to the opened state in response to a pressure differential between the wellbore annulus and the internal volume (60).

7. The downhole tool of Clause 6, wherein the valve (100) comprises a plate (110) being disposed at the fluid port (62) in the outer sleeve (58), at least a portion of the plate (110) moving from the closed state to the opened state in response to the pressure differential between the wellbore annulus and the internal volume (60).

8. The downhole tool of Clause 7, wherein the plate (110) defines a first end and a second end, the first end being disposed adjacent to the fluid port (62) and being disposed against an external surface of the outer sleeve (58), the second end extending over the fluid port (62), the second end as the portion of the plate (110) being movable relative to the first end; and wherein the plate (110) defines a groove (116) therein dividing the first end from the second end, the groove (116) being tuned to a threshold of the pressure differential;

and optionally wherein the second end is configured to bend, flex, detach, or snap at the groove (116).

9. The downhole tool of Clause 7 or 8, wherein the valve (100) comprises a cover (120) being affixed to the outer sleeve (58) against the plate (110), the cover (120) defining an aperture (122) therein, the plate (110) being movable relative to the aperture (122).

10. The downhole tool of Clause 9, wherein:

the plate (110) defines a lip (113) extending beyond the aperture (122) of the cover (120), the lip (113) on the plate (110) in the closed state engaging against the cover (120);

the plate (110) has a central portion (112) raised above a surface of the plate (110), the central portion (112) fitting into the aperture (122) of the cover (120) when the plate (110) is in the closed state;

the cover (120) defines a rim (123) disposed about a perimeter of the cover (120), the rim (123) surrounding an edge of the plate (110) in the closed position; and/or the valve (100) comprises a fixture attaching the plate (110) and the cover (120) to the outer sleeve (58).

11. The downhole tool of any one of Clauses 1 to 6, wherein the valve (100) comprises a breachable barrier (140) disposed across the fluid port (62), the breachable barrier (140) being configured to change from the closed state to the opened state in response to a positive threshold of the pressure differential, the breachable barrier (140) being configured to resist the change from the closed state to the opened state in response to at least an equalized threshold of the pressure differential.

12. The downhole tool of any one of Clauses 1 to 5, wherein the valve (100) comprises a dissolvable barrier (150) disposed across the fluid port (62), the dissolvable barrier (150) being configured to change from the closed state to the opened state in response to exposure to a downhole environmental factor.

13. The downhole tool of any one of Clauses 1 to 12, wherein the outer sleeve (58) defines a fill port (72) adjacent to the fluid port (62), the fill port (72) communicating with the internal volume (60), the fill port (72) being configured to receive grease into the internal volume (60) and being closed by a plug.

14. A liner system, comprising:

a downhole tool (50) according to any one of Clauses 1 to 13; and a liner (22) extending from the downhole tool (50).

15. A method of setting a downhole tool (50) in a wellbore (10), the method comprising:

deploying the downhole tool (50) in the wellbore (10), the downhole tool (50) having an outer sleeve (58) disposed on a housing (51) and defining an internal volume (60) therebetween, the outer sleeve (58) defining a fluid port (62) communicating the internal volume (60) with the wellbore (10), the fluid port (62) having a valve (100), the valve (100) being changeable from a closed state to an opened state;

at least restricting, through the valve (100) in the closed state, fluid communication through the fluid port (62) from the wellbore (10) to the internal volume (60);

actuating an actuator (56, 57, 80, 90) on the housing (51) by moving the outer sleeve (58) relative to the housing (51); and permitting fluid communication from the wellbore (10) to the internal volume (60) by changing the valve (100) from the closed state to the opened state.

16. The method of Clause 15, wherein changing the valve (100) from the closed state to the opened state comprises changing the valve (100) from the closed state to the opened state in response to a pressure differential between the wellbore (10) and the internal volume (60) by moving at least a portion of a plate (110) of the valve (100), the plate (110) being disposed at the fluid port (62) in the outer sleeve (58), the portion of the plate (110) moving from the closed state to the opened state in response to the pressure differential.

17. The method of Clause 16, wherein moving at least the portion of the plate (110) of the valve (100) comprises moving a first end of the plate (110) relative to a second end of the plate (110), the first end of the plate (110) extending over the fluid port (62), the second end of the plate (110) being disposed against an external surface of the outer sleeve (58), wherein optionally moving the first end of the plate (110) relative to the second end of the plate (110) comprises moving the first end at a groove (116) dividing the first end from the second end, the groove (116) being tuned to a threshold of the pressure differential; and wherein further optionally moving the first end at the groove (116) comprises bending, flexing, detaching, or snapping at the groove (116).

18. The method of Clause 15, wherein changing the valve (100) from the closed state to the opened state comprises changing the valve (100) from the closed state to the opened state in response to a pressure differential between the wellbore (52) annulus and the internal volume (60) by changing a breachable barrier (140) disposed across the fluid port (62) from the closed state to the opened state in response to the positive threshold of the pressure differential; and wherein at least restricting, through the valve (100) in the closed state, fluid communication through the fluid port (62) from the wellbore (10) to the internal volume (60) comprise resisting the change of the breachable barrier (140) from the closed state to the opened state in response to at least an equalized threshold of the pressure differential.

19. The method of Clause 15, wherein changing the valve (100) from the closed state to the opened state comprises at least partially dissolving a dissolvable barrier (150) disposed across the fluid port (62) from the closed state to the opened state in response to exposure to a downhole environmental factor.

The foregoing description of preferred and other embodiments is not intended to limit or restrict the scope or applicability of the inventive concepts conceived of by the Applicants. It will be appreciated with the benefit of the present disclosure that features described above in accordance with any configuration or aspect of the disclosed subject matter can be utilized, either alone or in combination, with any other described feature, in any other configuration or aspect of the disclosed subject matter.

In exchange for disclosing the inventive concepts contained herein, the Applicants desire all patent rights afforded by the appended claims. Therefore, it is intended that the appended claims include all modifications and alterations to the full extent that they come within the scope of the following claims or the equivalents thereof.

The invention claimed is:

1. A downhole tool for use in a wellbore, the downhole tool comprising:

a housing defining a bore therethrough;

an outer sleeve disposed on the housing, the outer sleeve being movable at least from a first position to a second position relative to the housing, the outer sleeve defining an internal volume with the housing and defining a fluid port, the fluid port communicating the internal volume with a wellbore annulus;

an actuator disposed on the housing and being actuated in response to the movement of the outer sleeve toward the second position; and a valve comprising a plate, the plate being disposed at the fluid port on the outer sleeve, at least a portion of the plate being movable, in response to a pressure differential between the wellbore annulus and the internal volume, from (i) a closed state at least restricting fluid communication from the internal volume to the wellbore annulus to (ii) an opened state permitting fluid communication from the wellbore annulus to the internal volume.

2. The downhole tool of claim 1, wherein the actuator comprises at least one of:

a packer disposed on the housing and being actuatable to seal the wellbore annulus in the wellbore in response to the movement of the outer sleeve toward the second position; and a slip disposed on the housing, the slip being actuatable to engage against the wellbore in response to the movement of the outer sleeve toward the second position.

3. The downhole tool of claim 1, wherein the housing defines a side port communicating with the bore; and wherein the actuator comprises a flow sleeve disposed on the housing and defining a side opening, the flow sleeve being moveable from a closed condition to an opened condition in response to the movement of the outer sleeve toward the second position, the side opening of the flow sleeve in the closed condition being sealed from fluid communication with the side port, the side opening of the flow sleeve in the opened condition being sealed in fluid communication with the side port.

4. The downhole tool of claim 1, wherein the plate defines a proximal end and a distal end, the proximal end being disposed adjacent to the fluid port and being disposed against an external surface of the outer sleeve, the distal end extending over the fluid port, the distal end as the portion of the plate being movable relative to the proximal end.

5. The downhole tool of claim 4, wherein the plate defines a groove therein dividing the proximal end from the distal end, the groove being tuned to a threshold of the pressure differential.

6. The downhole tool of claim 1, wherein the valve comprises a cover being affixed to the outer sleeve against the plate, the cover defining an aperture therein, the plate being movable relative to the aperture.

7. The downhole tool of claim 6, wherein at least one of:

the plate defines a lip extending beyond the aperture of the cover, the lip on the plate in the closed state engaging against the cover;

the plate has a central portion raised above a surface of the plate, the central portion fitting into the aperture of the cover when the plate is in the closed state;

the cover defines a rim disposed about a perimeter of the cover, the rim surrounding an edge of the plate in the closed state; and the valve comprises a fixture attaching the plate and the cover to the outer sleeve.

8. The downhole tool of claim 1, comprising a seal disposed between the housing and the outer sleeve and sealing the internal volume therebetween.

9. The downhole tool of claim 1, wherein the downhole tool is a liner hanger; and wherein the outer sleeve comprises:

a collar disposed on the housing and having a slip; and a polished bore receptacle connected to the collar and extending partially beyond an uphole end of the housing.

10. A liner system, comprising:

a liner hanger having the downhole tool according to claim 1; and a liner extending from the liner hanger.

11. A method used in a wellbore, the method comprising:

deploying the downhole tool of claim 1 in the wellbore;

at least restricting, through the valve in the closed state, fluid communication through the fluid port from the wellbore to the internal volume;

actuating the actuator on the housing by moving the outer sleeve relative to the housing; and permitting fluid communication from the wellbore to the internal volume by moving the at least the portion of the plate from the closed state to the opened state in response to the pressure differential between the wellbore annulus and the internal volume.

12. The method of claim 11, wherein the downhole tool is a liner hanger; and wherein actuating the actuator comprises setting a packer on the housing by:

moving the outer sleeve relative to the housing, thereby increasing the internal volume; and engaging a slip of the outer sleeve against the packer.

13. A downhole tool for use in a wellbore, the downhole tool comprising:

a housing defining a bore therethrough;

an outer sleeve disposed on the housing, the outer sleeve being movable at least from a first position to a second position relative to the housing, the outer sleeve defining an internal volume with the housing and defining a fluid port, the fluid port communicating the internal volume with a wellbore annulus, wherein the outer sleeve defines a fill port adjacent to the fluid port, the fill port communicating with the internal volume, the fill port being configured to receive grease into the internal volume and being closed by a plug;

an actuator disposed on the housing and being actuated in response to the movement of the outer sleeve toward the second position; and a valve disposed at the fluid port on the outer sleeve and being configured to change from a closed state to an opened state, the valve in the closed state at least restricting fluid communication from the internal volume to the wellbore annulus, the valve in the opened state permitting fluid communication from the wellbore annulus to the internal volume.

14. The downhole tool of claim 13, wherein the actuator comprises at least one of:

a packer disposed on the housing and being actuatable to seal the wellbore annulus in the wellbore in response to the movement of the outer sleeve toward the second position; and a slip disposed on the housing, the slip being actuatable to engage against the wellbore in response to the movement of the outer sleeve toward the second position.

15. The downhole tool of claim 13, wherein the valve is configured to change from the closed state to the opened state in response to a pressure differential between the wellbore annulus and the internal volume.

16. The downhole tool of claim 15, wherein the valve comprises a plate being disposed at the fluid port in the outer sleeve, at least a portion of the plate moving from the closed state to the opened state in response to the pressure differential between the wellbore annulus and the internal volume.

17. The downhole tool of claim 15, wherein the valve comprises a breachable barrier disposed across the fluid port, the breachable barrier being configured to change from the closed state to the opened state in response to a positive threshold of the pressure differential, the breachable barrier being configured to resist the change from the closed state to the opened state in response to at least an equalized threshold of the pressure differential.

18. The downhole tool of claim 13, wherein the valve comprises a dissolvable barrier disposed across the fluid port, the dissolvable barrier being configured to change from the closed state to the opened state in response to exposure to a downhole environmental factor.

19. A method used in a wellbore, the method comprising:

deploying the downhole tool of claim 13 in the wellbore;

at least restricting, through the valve in the closed state, fluid communication through the fluid port from the wellbore to the internal volume;

actuating the actuator on the housing by moving the outer sleeve relative to the housing; and permitting fluid communication from the wellbore to the internal volume by changing the valve from the closed state to the opened state.

20. The method of claim 19, wherein changing the valve from the closed state to the opened state comprises changing a breachable barrier disposed across the fluid port from the closed state to the opened state in response to a positive threshold of a pressure differential between the wellbore and the internal volume; and wherein at least restricting, through the valve in the closed state, fluid communication through the fluid port from the wellbore to the internal volume comprise resisting the change of the breachable barrier from the closed state to the opened state in response to at least an equalized threshold of the pressure differential.

21. The method of claim 19, wherein changing the valve from the closed state to the opened state comprises at least partially dissolving a dissolvable barrier disposed across the fluid port from the closed state to the opened state in response to exposure to a downhole environmental factor.

22. The method of claim 19, wherein the downhole tool is a liner hanger; and wherein actuating the actuator comprises setting a packer on the housing by:

moving the outer sleeve relative to the housing, thereby increasing the internal volume; and engaging a slip of the outer sleeve against the packer.

23. The downhole tool of claim 13, wherein the housing defines a side port communicating with the bore; and wherein the actuator comprises a flow sleeve disposed on the housing and defining a side opening, the flow sleeve being moveable from a closed condition to an opened condition in response to the movement of the outer sleeve toward the second position, the side opening of the flow sleeve in the closed condition being sealed from fluid communication with the side port, the side opening of the flow sleeve in the opened condition being sealed in fluid communication with the side port.

24. The downhole tool of claim 13, comprising a seal disposed between the housing and the outer sleeve and sealing the internal volume therebetween.

25. The downhole tool of claim 13, wherein the downhole tool is a liner hanger; and wherein the outer sleeve comprises:

a collar disposed on the housing and having a slip; and a polished bore receptacle connected to the collar and extending partially beyond an uphole end of the housing.

26. A liner system, comprising:

a liner hanger having the downhole tool according to claim 15; and a liner extending from the liner hanger.

* * * * *